US005818164A

United States Patent [19]

Winsor

[11] Patent Number: 5,818,164

[45] Date of Patent: Oct. 6, 1998

[54] FLUORESCENT LAMP WITH ELECTRODE HOUSING

[75] Inventor: Mark D. Winsor, Olympia, Wash.

[73] Assignee: Winsor Corporation, Olympia, Wash.

[21] Appl. No.: 964,420

[22] Filed: Nov. 4, 1997

Related U.S. Application Data

[63] Continuation of Ser. No. 677,512, Jul. 10, 1996, abandoned, which is a continuation of Ser. No. 348,795, Dec. 2, 1994, Pat. No. 5,536,999.

[51] Int. Cl.[6] ..... H01J 17/02

[52] U.S. Cl. ..... 313/493; 313/492; 313/613; 313/600; 313/609

[58] Field of Search ..... 313/483, 491, 313/492, 493, 494, 489, 581, 595, 600, 622, 613, 614, 513, 514, 609

[56] References Cited

U.S. PATENT DOCUMENTS

| | | | |
|---|---|---|---|
| 2,255,431 | 9/1941 | Marden et al. | 176/122 |
| 2,405,518 | 8/1946 | Polevitzky | 176/122 |
| 3,121,184 | 2/1964 | Fox | 313/207 |
| 3,198,943 | 8/1965 | Pistey | 240/51.11 |
| 3,253,176 | 5/1966 | Pate et al. | 313/204 |
| 3,508,103 | 4/1970 | Young | 313/109 |
| 3,967,153 | 6/1976 | Milke et al. | 313/489 |
| 4,117,374 | 9/1978 | Witting | 315/99 |
| 4,234,817 | 11/1980 | Teshima et al. | 313/493 |
| 4,363,998 | 12/1982 | Graff et al. | 313/487 |
| 4,743,799 | 5/1988 | Loy | 313/493 |
| 4,767,965 | 8/1988 | Yamano et al. | 313/491 |
| 4,839,555 | 6/1989 | O'Mahoney | 313/493 |
| 4,851,734 | 7/1989 | Hamai et al. | 313/485 |
| 4,924,143 | 5/1990 | Imamura | 313/495 |
| 5,066,257 | 11/1991 | Farner et al. | 445/26 |
| 5,220,249 | 6/1993 | Tsukada | 315/246 |
| 5,319,282 | 6/1994 | Winsor | 315/169.4 |
| 5,343,116 | 8/1994 | Winsor | 313/493 |
| 5,463,274 | 10/1995 | Winsor | 313/493 |
| 5,466,990 | 11/1995 | Winsor | 313/56 |
| 5,479,071 | 12/1995 | Lynn | 313/514 |
| 5,536,999 | 7/1996 | Winsor | 313/493 |

FOREIGN PATENT DOCUMENTS

| | | | |
|---|---|---|---|
| 0 066 495 A2 | 12/1982 | European Pat. Off. . | |
| 43 13 017 A1 | 12/1994 | Germany . | |
| 60216435 | 10/1985 | Japan . | |
| 62-208536 | 9/1987 | Japan . | |
| 64-17374 | 1/1989 | Japan | H01J 61/30 |
| 2-72552 (A) | 3/1990 | Japan . | |
| 3-46748 (A) | 2/1991 | Japan . | |
| 3-129659 (A) | 6/1991 | Japan . | |
| 3-222253 (A) | 10/1991 | Japan . | |
| 2032681 | 5/1980 | United Kingdom . | |
| WO 92/02947 | 2/1992 | WIPO . | |

*Primary Examiner*—Sandra L. O'Shea
*Assistant Examiner*—Vip Patel
*Attorney, Agent, or Firm*—Seed and Berry LLP

[57] ABSTRACT

A flat planar fluorescent lamp having barrier structures overlaying the electrodes is described. The barrier structures include barrier walls and platforms between the electrodes and the lamp cover with passageways between the platforms and the lamp cover. The barrier structures cause the electric discharge between the lamp electrodes to pass between the platforms and the lamp cover. The interior of the lamp and the top of the platform are coated with a fluorescent material such that the lamp produces light throughout its interior, including the region directly above the electrode, thereby providing a source of light in an area which would otherwise be a dark region surrounding the electrode. In one embodiment, a cold electrode, a hot electrode, an ion barrier, and a tubulation are formed in a glass seal as a single unit, placing the terminals of the electrodes and the tipped-off tubulation in a small region of the lamp to permit easier access and alignment. Two tubulations are used to permit the lamp to be pumped at locations adjacent the two electrodes to reduce problems associated with free ions in the region around the electrode. In one embodiment, a metal lamp body having an insulative coating and including an integral barrier structure is formed using conventional metal stamping techniques. In another embodiment, the lamp body is formed from glass which is shaped according to known techniques to form an integral barrier wall. The platform is then attached to the integral barrier wall and supported at its sides by ledges formed in the sidewall and channel wall of the lamp.

14 Claims, 4 Drawing Sheets

FLUORESCENT LAMP WITH ELECTRODE HOUSING

CROSS-REFERENCES TO RELATED APPLICATIONS

This application is a file wrapper continuation of U.S. patent application Ser. No. 08/677,512, filed Jul. 10, 1996, now abandoned, which is a continuation of U.S. patent application Ser. No. 08/348,795, filed Dec. 2, 1994, now issued as U.S. Pat. No. 5,536,999.

TECHNICAL FIELD

The present invention relates to fluorescent lamps and, more particularly, to planar fluorescent lamps designed for uniform light distribution.

BACKGROUND OF THE INVENTION

It is often desirable to have a uniform light source. For example, in a backlit panel display, such as in advertising or in a display screen, a backlight advantageously illuminates the display surface. Such backlights are preferably uniform and bright and occupy a minimum of space.

Generally two approaches are used to provide such illumination. In one approach, a single light source is positioned behind the display, often using a central light emitter and a reflective dish. One such illuminator is described by Ogawa et al. in U.S. Pat. No. 4,803,399. Such systems have limited applicability in flat panel types of displays, in part, because they require a relatively large volume to spread the light and have nonuniformities caused by the cathodes being exposed.

One approach to lighting which can reduce this problem is the use of a flat panel fluorescent lamp. Such lamps can provide a wide area of relatively uniform illumination while occupying a relatively small volume. However, such planar fluorescent lamps are often difficult and expensive to fabricate in large sizes. Even if such larger lamps were readily producible, such large, flat fluorescent displays are typically fragile. Moreover, uniformity of light distribution is hard to produce and maintain in large lamps.

To reduce the problems associated with large flat panel fluorescent lamps, multiple lamps may be tiled in a two-dimensional array. In such an array the light sources may be positioned substantially adjacent each other, overcoming in large part, the dead space between light sources of the multiple lamp approach discussed above.

Even where lamps are tiled, uniformity problems may exist. In conventional flat planar fluorescent lamps, a region of little or no illumination typically surrounds the electrodes used to generate a discharge current. Such dark regions, known as Crooke's spaces and Faraday dark spaces, detract from the uniformity of the display, causing "dark" regions in the lamp.

Tiling of lamps does not eliminate the nonuniformity caused by the dark regions. In a tiled array of conventional planar fluorescent lamps, the dark regions remain, causing the light to be non-uniform. Even when lamps are not for use in large panel applications, such dark regions are undesirable. For instance, when lamps are used in heads-up displays in aircraft or as backlights to smaller displays, such dark regions can cause undesirable variations in an illuminated image.

SUMMARY OF THE INVENTION

A planar fluorescent lamp for emitting light is described. The lamp comprises an insulative lamp body having a plurality of sidewalls and end walls and a lower wall. The lamp includes a lamp cover mounted atop the lamp body such that the lamp body and cover define a chamber. A plurality of walls are within the chamber and define a serpentine discharge channel. A gas within the chamber emits ultraviolet energy in response to an electrical discharge along the discharge channel. A pair of electrodes supply electrical power to produce the electrical discharge. The first electrode is located adjacent a first end of the serpentine channel and the second electrode is adjacent a second end of the serpentine channel, whereby the discharge channel is substantially defined by the serpentine channel. A fluorescent material produces visible light in response to the ultraviolet energy.

The lamp also includes first and second barrier walls within the discharge channel, intermediate the first electrode and second electrodes and adjacent the first and second electrodes, respectively. The barrier walls project upwardly from the lower wall toward the cover and extend laterally substantially between interior walls adjacent the electrode and a respective one of the sidewalls. Platforms project transversely from the barrier walls and are positioned intermediate the first electrode and the cover and spaced apart from the cover. The platforms define passageways to provide a path for the discharge to pass between the platforms and the cover. The fluorescent material coats upper surfaces of the platforms to produce visible light within the passageway between the lamp cover and the platforms.

In an alternative embodiment, the lamp includes first and second electrode covers integral to and projecting upwardly from the lower wall to partially surround the first and second electrodes, respectively, with at least a portion of each of the electrode covers intermediate the first and second electrodes. The electrode covers are positioned to provide a barrier such that the electrical discharge is caused to follow an indirect path from the first electrode to the second electrode, the indirect path passing between the electrodes and the cover. The fluorescent material coats an upper surface of the electrode covers to produce visible light along an indirect path between the electrodes and the lamp cover.

In one embodiment, the electrode covers are domic structures projecting upwardly from the lower wall toward the lamp cover and substantially covering the first and second electrodes, respectively. The domic structures include openings to permit the discharge to exit the domic structures and to enter the chamber. In this embodiment, the lamp body is formed from a metal sheet overlaid by an insulative layer and the electrode covers are integral to the lamp body.

In an alternative embodiment, a second lamp cover is mounted in a fixed position overlaying the first lamp cover.

DETAILED DESCRIPTION OF THE INVENTION

Figure 1:
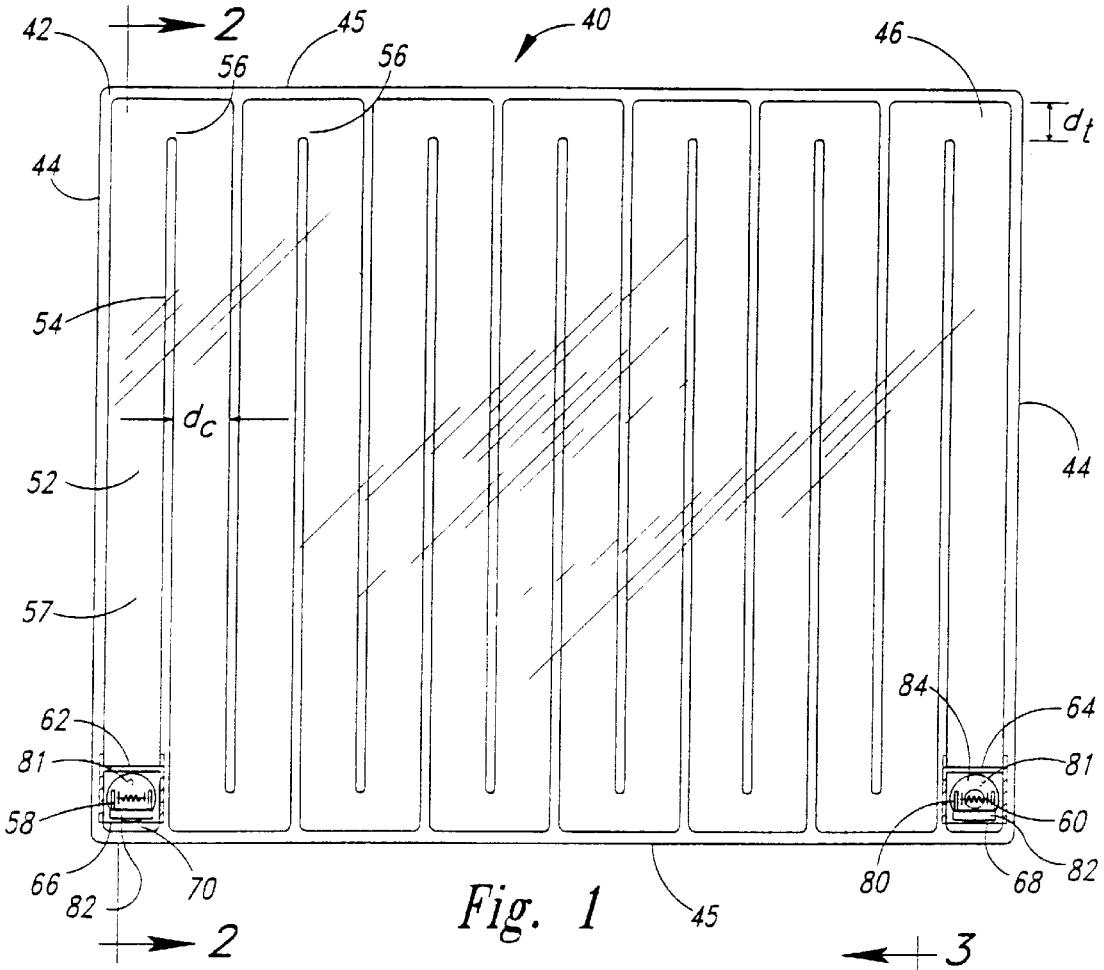
FIG. 1 is a top plan view of one embodiment of a planar fluorescent lamp according to the invention.
Figure 2:
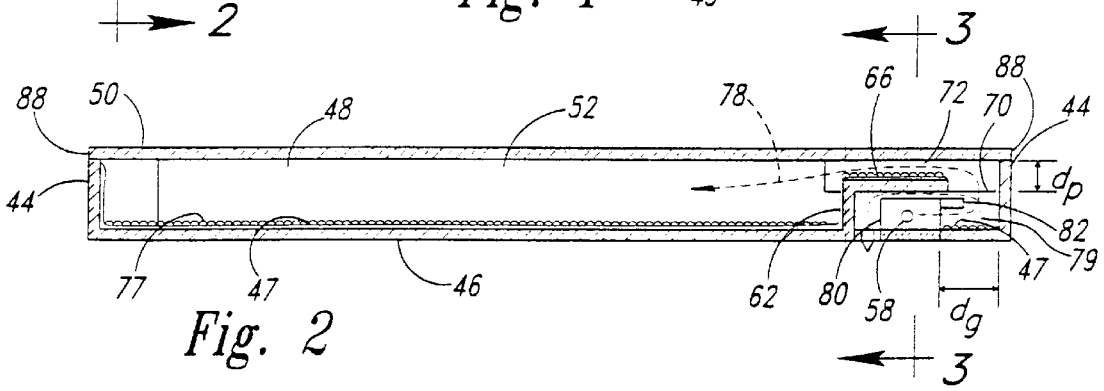
FIG. 2 is a side cross-sectional view along a line 2—2 of the lamp of FIG. 1.

As shown in FIGS. 1 and 2, a planar fluorescent lamp 40 includes a lamp body 42 having two sidewalls 44 and two endwalls 45 forming a generally rectangular shape. The sidewalls 44 and endwalls 45 project upwardly from a base 46 (best seen in FIG. 2) to a device cavity 48. The lamp body 42 is formed from an insulative material, such as a glass. Other materials may be used for the lamp body, including insulatively coated metal, as described below with respect to FIG. 7.

The inner surface of the lamp body 42 is preferably coated with a reflective layer 47 of an insulative material, such as a porcelain enamel. In some applications, it may be desirable to eliminate the reflective coating so that the lamp emits light from its lower and upper surfaces.

A transparent cover 50 overlays the lamp body 42 and mates to the upper edges of the sidewalls 44 and endwalls 45 to form a chamber 52 within the lamp 40. Channel walls 54 extend between the cover 50 and the base 46 and project from one sidewall 44 toward an opposite sidewall 44, ending a short distance $d_t$ from the opposite sidewall 44 and leaving a gap 56 therebetween. As best seen in the top view of FIG. 1, the sidewalls 44, endwalls 45 and the channel walls 54 form a serpentine channel 57 from a first electrode 58 to a second electrode 60.

A pair of barrier walls 62, 64 are positioned in the serpentine channel 57 near the electrodes 58, 60. Each of the barrier walls 62, 64 projects upwardly from the base 46 toward the cover 50, ending a short distance dp from the cover 50, leaving an opening between the top of the barrier wall 62, 64 and the cover 50. The barrier walls 62, 64 are formed integrally to the lamp body 42 and extend laterally between one of the sidewalls 44 and its adjacent channel wall 54, parallel to the endwalls 45. The barrier walls 62, 64 form a lateral insulative barrier in a lower portion of the serpentine channel 57.

Insulative platforms 66, 68 project from the barrier walls 62, 64 along the serpentine channel 57, passing between their respective electrodes 58, 60 and the lamp cover 50. The platforms 66, 68 of FIG. 1 are shown as being transparent to more clearly present the areas surrounding the electrodes 58, 60. As shown in FIG. 2, the reflective layer 47 extends to coat the upper surface of the platforms 66, 68. Thus, the platforms are not typically transparent.

Figure 3:
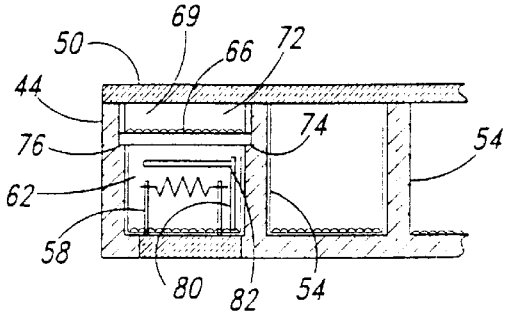
FIG. 3 is a detail, side cross-sectional view of a portion of the lamp of FIG. 1 along the line 3—3 of FIG. 2, showing an electrode and a platform above the electrode.

As best seen in FIGS. 2 and 3, the platforms 66, 68 are spaced apart from the cover 50, providing a passageway 72 above the electrodes 58, 60. The platforms 66, 68 end a short distance $d_g$ from the respective end walls 44, leaving a small discharge gap 70 therebetween.

The platforms 66, 68 are supported by the barrier walls 62, 64 at their innermost ends, and are supported at the sides by ledges 74, 76 (best seen in FIG. 3) integrally formed in the sidewalls 44 and the channel walls 54. The platforms 66, 68 are of an insulative, or insulatively coated, material, preferably a glass selected to have a thermal coefficient of expansion similar to that of the material of the lamp body 42 and the integral barrier walls 62, 64.

A fluorescent layer 77 (best seen in FIG. 2) coats the inner surface of the lamp body 42. While the fluorescent layer 77 in this embodiment overlays the upper surface of the base 46, the fluorescent layer 77 may alternatively overlay the lower surface of the cover 50. In another alternative, both the lower surface of the cover 50 and the inner surface of the lamp body 42 may be coated by the fluorescent layer 77.

A known ultraviolet emissive gas, typically a mercury vapor in a noble gas environment, is placed in the chamber 52. The electrodes 58, 60 include terminals 71 (best seen in FIGS. 2 and 3) which extend to the exterior of the lamp body 42 to permit electrical connection to an external power source (not shown). As is known, upon electrical excitation, the electrodes 58, 60 form an electrical discharge through the mercury vapor along the serpentine channel 57. In response, the mercury vapor emits ultraviolet energy which strikes the fluorescent coating 77. The fluorescent coating 77, upon being struck by the ultraviolet energy from the mercury vapor, will emit visible or near-visible light along the serpentine channel 57. This light passes through the transparent cover 50 and is emitted outwardly from the lamp 40.

The serpentine channel 57 defined by insulative sidewalls 44 and endwalls 45 defines the path along which the electrical discharge will flow between the electrodes 58, 60. To provide a complete insulative barrier between adjacent sections of the serpentine channel 57, the upper edges of the channel walls 54 are preferably bonded to the cover 50, typically with a glass solder. The insulative barrier reduces problems associated with shortcutting of the electric discharge. That is, as the electric discharge travels along a section of the serpentine channel 57, it will, if permitted, pass over the channel wall 54 to an adjacent section, rather than passing through the gap 56. If shortcutting occurs, a portion of each of the sections of the serpentine channel 57 will not be fully illuminated, reducing uniformity of illumination. Moreover, the distance along which the discharge travels through the mercury vapor will be reduced, reducing the efficiency of the lamp 40. The insulative barrier prevents the discharge from taking the shortcut path.

The barrier wall 62 and the platform 66 form an L-shaped barrier to prevent the electrical discharge from traveling directly along the serpentine channel 57 in the region surrounding the electrodes 58, 60. As indicated by the broken-line arrow 78 in FIG. 2, the electrical discharge must pass through the discharge gap 70 and the passageway 72, passing between the platform 66 and the cover 50.

A dark region 79 surrounding the electrode caused by the presence of the electrode within the channel is concealed beneath the platforms 66, 68. Because the electrical discharge passes through the mercury vapor above the platforms 66, 68, the mercury vapor emits ultraviolet energy in the passageway 72 above the platforms 66, 68. This ultraviolet energy causes the fluorescent coating 77 on the upper surface of the platforms 66, 68 to emit visible light above the electrodes 58, 60. Light will thus be emitted throughout the serpentine channel 57, even in the regions directly above the electrodes 58, 60. Thus, light is emitted from substantially all of the area of the lamp 40.

A tubulation 81 (FIGS. 1, 2, and 4) consisting of a sealed glass tube is positioned adjacent a first of the electrodes 58. Prior to being sealed to form the tubulation 81, the tubulation provides an access port through which a vacuum may be applied to the chamber 52. Because the region around the second electrode 60 is substantially the same as the region around the first electrode 58, the second electrode 60 includes a complementary tubulation 81 as best seen in FIG. 1. The use of two tubulations 81, each substantially adjacent its respective electrode 58, 60, allows the chamber to be evacuated effectively in the regions around the electrodes 58, 60. The inventors have determined that by applying the vacuum locally in the regions around the electrodes 58, 60, gaseous impurities such as free ions are minimized in those regions. This helps to prevent degradation of the lamp 40 due to gaseous impurities in the regions near the electrodes 58, 60. Also, the vacuum can be applied at one end of the serpentine channel 51 to draw impurities through the lamp. Such double-ended pumping removes impurities more completely than conventional single tubulation pumping.

Secondary electrodes 80 are also positioned adjacent the electrodes 58, 60. The secondary electrodes 80 are substantially planar electrodes which may be used as cold cathodes to permit the lamp to be driven in cold cathode operation. The combination of cold cathode and hot cathode electrodes is described in U.S. Pat. No. 5,343,116, which is incorporated herein by reference.

As is known, ions within the chamber 52 may be driven by the electric fields within the lamp 40 along the discharge path of the electrical discharge. In the absence of any barrier, the ions, driven by the electric fields would strike the electrodes 58, 60 and sputter away emissive electrode coatings and material from the electrode itself. Ion barriers 82 mounted along the discharge path, near the electrodes 58, 60 advantageously provide a shield to protect the electrodes 58, 60 from these ions. The ion barriers are insulatively coated, planar metal members which extend across a portion of the serpentine channel 57, parallel to the electrodes 58, 60 The ion barriers 82 provide a relatively large target, blocking the path of the ions traveling toward the electrodes 58, 60. Ions traveling toward the electrodes 58, 60 strike the ion barriers 82 rather than the electrodes 58, 60 and ion damage to the electrodes 58, 60 due to ion sputtering is minimized extending the life of the lamp 40. While some sputtering of the ion barrier 82 may occur, the relatively large mass of the ion barrier 82 allows it to withstand a substantial amount of ion sputtering while still providing protection to the electrodes 58, 60.

Figure 4:
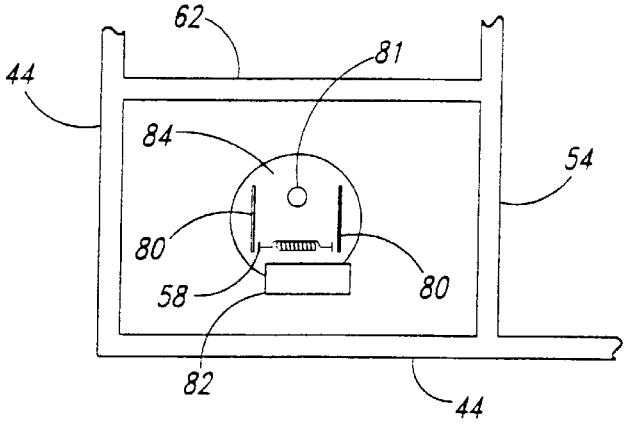
FIG. 4 is a detail top plan view of a portion of the embodiment of FIG. 1 showing the region around the electrode.

As best seen in FIG. 4, the tubulation 81, secondary electrode 80, first electrode 58 and ion barrier 82 are all grouped together in a single glass seal 84. Because the structure associated with the second electrode 60 is substantially identical to the structure surrounding the first electrode 58, only the structure surrounding the first electrode 58 will be described.

The grouping of the tubulation 81, electrode 58, secondary electrode 80, and ion barrier 82 into a single unit permits all of these components to be incorporated simultaneously into the lamp 40 thereby simplifying assembly. The entire assembly is mounted to the lamp body 42 as a unit, and the glass seal 84 is bonded to the lamp body 42 to form an airtight seal, typically by heating the glass seal 84 to form a glass weld. Because the tubulation 81, the first electrode 58 and the secondary electrode 80 are held in a single compact assembly, the exterior tip of the tubulation 81, the terminals of the electrode 58, the terminals of the secondary electrodes 80 are all grouped in one small area at the rear of the lamp 40. Consequently, only a small portion of the exterior surface of the lamp body 42 is occupied by these elements, permitting them to be concealed easily.

The serpentine channel 57 of FIG. 1 is used as a discharge channel because it provides an increased discharge length relative to a discharge directly between the electrodes 58, 60 thereby providing improved efficiency, as is known. Alternatively, the serpentine channel 57 formed by the channel walls 54 may be eliminated where efficiency or other concerns permit. In such an embodiment, shown in FIGS. 5 and 6, the electrodes 58, 60 are placed adjacent opposite sidewalls 44 and positioned to provide a uniform, centralized discharge.

In this embodiment, the reflective layer 47 coats the outside of the lamp body 42. Because the reflective layer 47 is separated from the chamber 52, light produced within the chamber 52 spreads as it passes through the lamp body 42 to the reflective layer 47 and back into the chamber 52. The spreading distributes the light throughout the lamp body 42 increasing the uniformity of light emitted by the lamp 40.

While the lamp body 42 and the platforms 66, 68 of FIGS. 1–6 are preferably of glass, other materials such as metal may be used. For example, in an alternative embodiment shown in FIGS. 7, 8 and 9, the lamp 40 includes a lamp body 88 formed from stamped metal. As with the lamp of FIG. 1, the lamp of FIGS. 7, 8 and 9 includes a serpentine channel 57 formed from a plurality of channel walls 54 and endwalls 45. At either end of the serpentine channel 57 are the first electrode 58 and the second electrode 60. To prevent possible detrimental effects of the metal body 42 on the operation of the lamp 40, the reflective layer 47 is an insulative material having a coefficient of thermal expansion matched to that of the lamp body 40. The construction of a stamped metal fluorescent lamp is described in detail in co-pending U.S. application Ser. No. 08/198,495, which is incorporated herein by reference.

In this embodiment, the barrier walls 62, 64 and the platforms 66 of FIG. 1 are replaced by integral surfaces 90 formed by a depression in the lower surface 92 of the lamp body 88. As the lamp 40 is stamped, an opening 94 is formed at one end of the integral surface 90 to permit communication with the interior of the lamp 40. The formation of such depressions and openings is well-known in the cost of stamping of metal products.

As with the embodiment of FIG. 1, a glass seal 84 is inserted at each end of the serpentine channel 57. Each of the glass seals 84 includes an electrode 58, 60, respectively, a secondary electrode 80, a tubulation 81, and an ion barrier 82. As the lamp is assembled, the glass seal 84 containing the electrode 58, the secondary electrode 80, the tubulation and the ion barrier is inserted into the depression formed by the stamping of the integral surface 90 and is concealed beneath the integral surface 90. The glass seal 84 is then bonded to the lamp body 88 using conventional techniques, such as glass solder.

Figure 9:
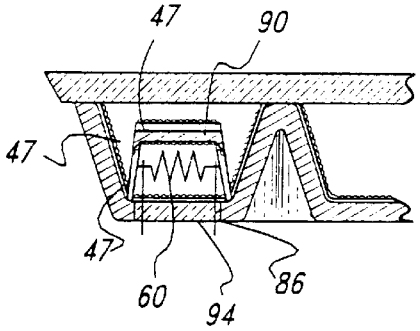
FIG. 9 is a detail side cross-sectional view of a portion of the lamp of FIG. 7.
Figure 8:
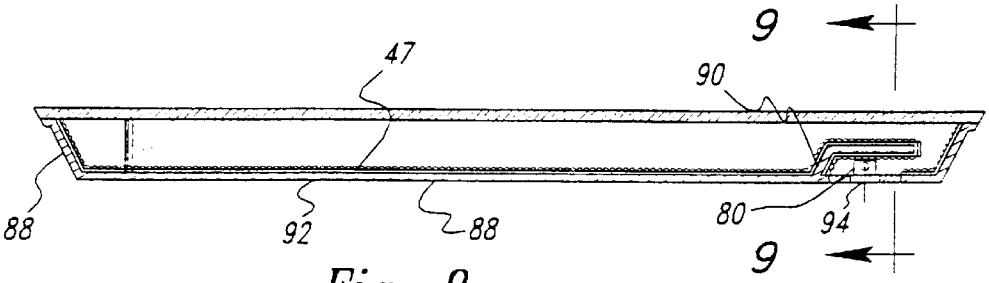
FIG. 8 is a side cross-sectional view of the lamp of FIG. 7 having a metal body.
Figure 7:
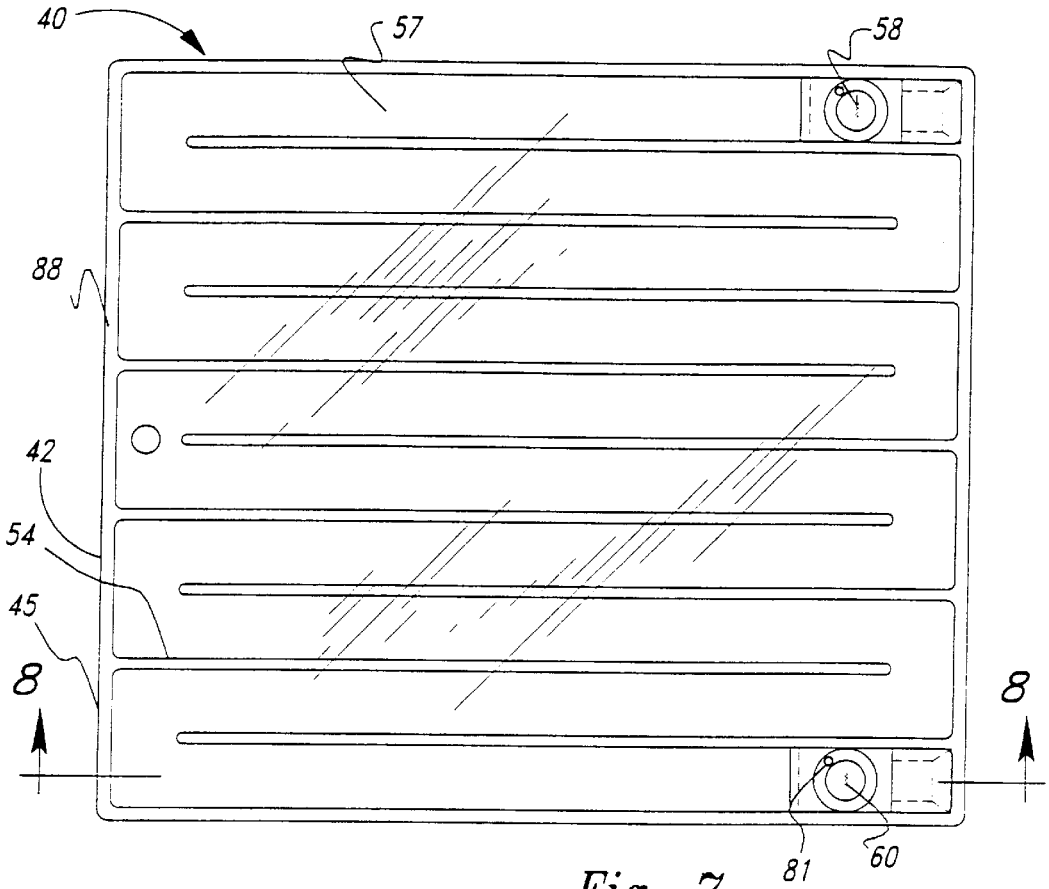
FIG. 7 is a top plan view of a planar fluorescent lamp according to the invention having a stamped metal body.

Operation of the lamp of FIGS. 7, 8 and 9 is similar to the operation of the lamp of FIG. 1. The lamp is activated by energization of the first electrode 58 and the second electrode 60, causing a discharge to travel along the serpentine channel 57 between the first electrode 58 and the second electrode 60. The discharge travels through the mercury vapor within the lamp 40 and causes the mercury vapor to emit ultraviolet light. The ultraviolet light strikes the fluorescent layer 77 and causes the fluorescent layer 77 to emit visible light throughout the lamp.

As in the embodiment of FIG. 1, the fluorescent layer 77 covers the integral surface 90 above the electrode 58, such that light is emitted throughout substantially the entire inner area of the lamp 40, including the region directly above the electrode 58. To improve uniformity of light distribution at the perimeter of the lamp 40, the edges of the lamp cover 50 are beveled to reflect light outwardly from the cover 50. To further increase the light reflected at the beveled edges, a reflective edge layer 47A coats the beveled edges of the cover 50.

Figure 10:
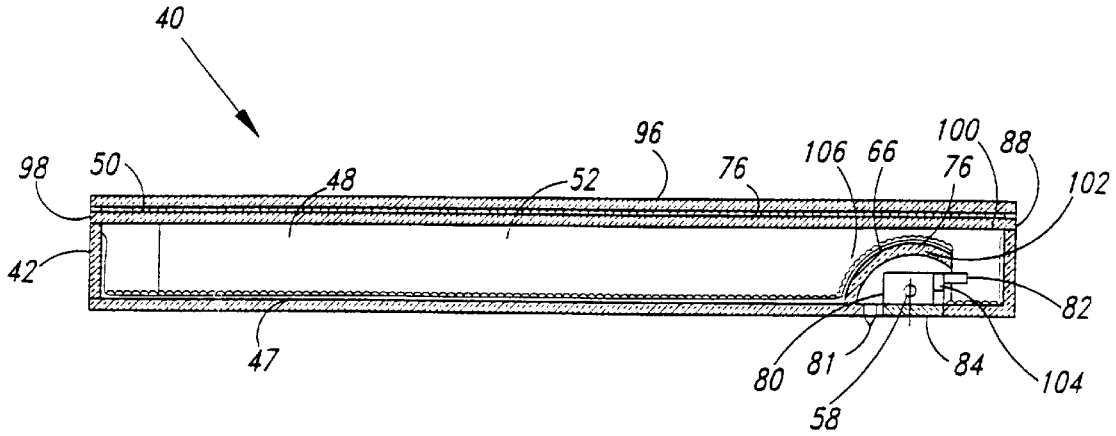
FIG. 10 is a side cross-sectional view of an alternative embodiment of an alternative embodiment of the invention having dual lamp covers and a dome-like electrode cover.

In another alternative embodiment shown in FIG. 10, the lamp 40 includes a second lamp cover 96 in addition to the original lamp cover 50. In this dual cover embodiment, a second layer of fluorescent material 76 is placed between the lamp cover 50 and the second lamp cover 96 forming a sandwich-like structure. The second lamp cover 96 is bonded in direct contact with the original lamp cover 50 by glass solder beads 98, 100 with the second fluorescent layer 76 trapped therebetween. While the lamp 40 is shown with the second lamp cover 96 contacting the original lamp cover 50, a structure where the second lamp cover 96 is spaced apart from the original lamp cover 50 to define a second chamber (not shown) is also within the scope of the invention.

In this embodiment, the second fluorescent layer 76 is exterior to the chamber 52 and the original fluorescent layer 77 is within the chamber 52. It can be seen that the original fluorescent layer 77 can be eliminated where desired, leaving only the second fluorescent layer 76 such that no fluorescent material remains in the chamber 52. This advantageously prevents the problems of phosphor migration within the lamp. For example, phosphor from the fluorescent layer 77 may migrate into the lamp body 42, causing a conductive path through the insulative glass. These conductive paths cause a shortcutting of the electrical discharge, reducing the efficiency of the lamp, as is known.

The second fluorescent layer 76 forms a continuous light emissive sheet above the lamp cover 50 and below the second lamp cover 96. Because the sheet is continuous, light is emitted across the entire upper surface, improving uniformity by eliminating dark areas above the channel walls. The lifetime of the fluorescent material is also increased because the phosphors in the fluorescent material are separated from the mercury vapor.

To further improve the uniformity of light emission from the lamp 40, the lower surface of the lamp body 42 is also coated with the second fluorescent layer 76 such that ultraviolet light traveling through the lamp body 42 will cause the fluorescent layer 76 on lower surface to emit light. The light produced by the fluorescent layer 76 on the lower surface of the lamp body 42 provides an additional continuous light emissive sheet, thereby improving the overall uniformity of light emission from the lamp 40.

Figure 5:
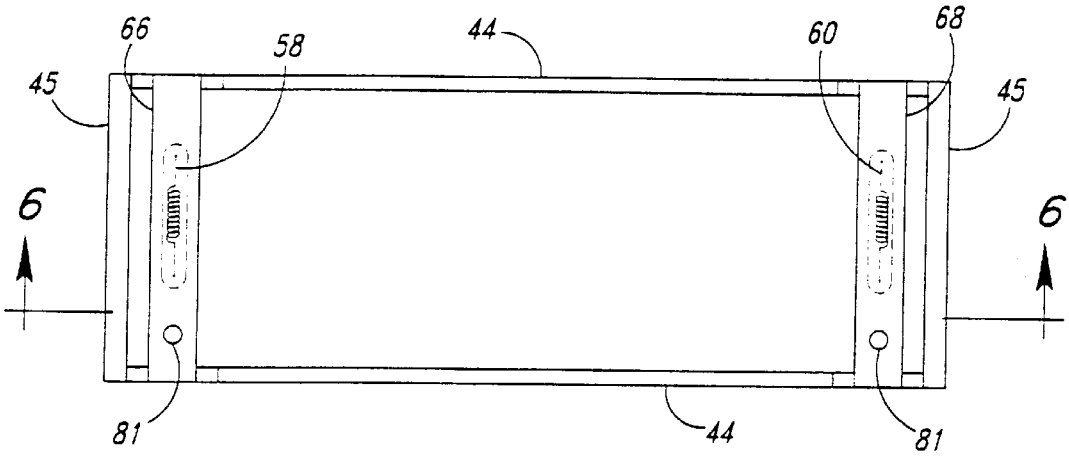
FIG. 5 is a top plan view of an embodiment of a planar fluorescent lamp having a linear discharge channel.
Figure 6:
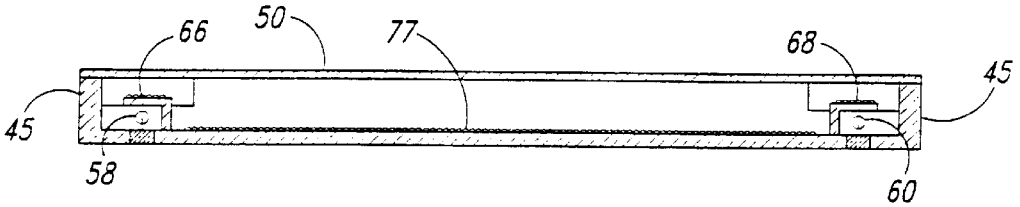
FIG. 6 is a side cross-sectional view of the lamp of FIG. 4 along a line B–B'.

While the dual lamp cover structure is shown in FIG. 10, such a dual lamp structure may also be employed with the lamp body 42 of FIG. 1, with the non-serpentine embodiment of FIGS. 4 and 5, or with the metal lamp body 88 of FIGS. 7, 8 and 9. Also, the secondary lamp cover 96 can be eliminated, leaving the fluorescent layer 76 exposed. In such an embodiment, the fluorescent layer 76 may also cover the lower surface of the lamp body 42, similarly to the lamp of FIG. 10.

The lamp 40 of FIG. 10 also employs a different structure to conceal the electrodes 58, 60. This structure, shown in FIGS. 11 and 12, eliminates the need for the barrier walls to be formed in or bonded to the lamp body 42. As before, the structure associated with the second electrode is substantially the same as that of the first electrode 58. Thus, only the structure associated with the first electrode 58 will be described.

Figure 11:
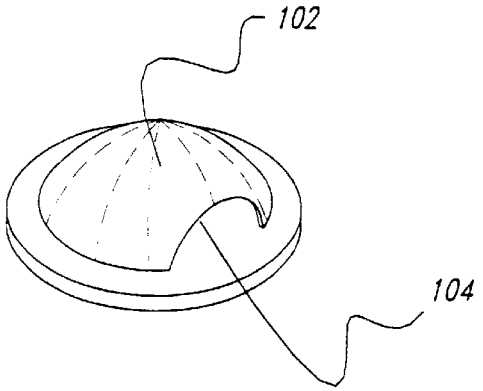
FIG. 11 is a detail isometric view of the dome-like electrode cover removed from the lamp of FIG. 10.
Figure 12:
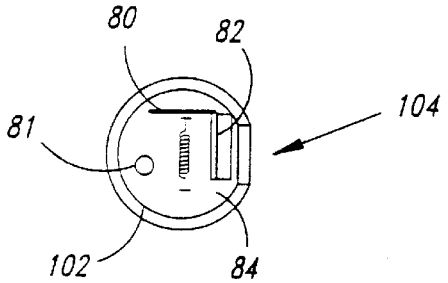
FIG. 12 is a bottom plan view of an electrode structure within the dome-like electrode cover removed from the lamp of FIG. 10.

For ease of fabrication, this embodiment employs a unitary electrode structure formed from a dome-like electrode housing 102, the tubulation 81, the ion barrier 82, the secondary electrode 80, all incorporated with the glass seal 84 in a unitary assembly. The dome-like housing 102 is a metal portion of a hollow sphere which is coated by the insulation bonded to the glass seal 84 by glass solder. As shown in FIGS. 10 and 11, the dome-like housing 102 partially surrounds the electrode 58, the ion barrier 82, the secondary electrode 80, and the tubulation 81. A discharge opening 104 provides a passageway through which the electrical discharge may exit the dome-like housing and enter the serpentine channel.

Operation of this embodiment is substantially the same as with the previously described embodiments. In this embodiment, the electrical discharge between the electrodes 58, 60 exits the dome-like structure through the discharge opening 104 before traveling along the serpentine channel 57. As before, the fluorescent layer 77 covers an area (in this case, an upper surface 106 of the dome-like structure) above the electrode 58 such that light is emitted in an area above the electrode 58. Note that the second fluorescent layer 76 also overlays the dome-like structure 102 and the lower surface of the lamp body. To allow ultraviolet light to activate the portion of fluorescent layer on the layer surface of the lamp body, the reflective layer 47 is replaced with an ultraviolet transmissive insulative layer 97.

Figure 13:
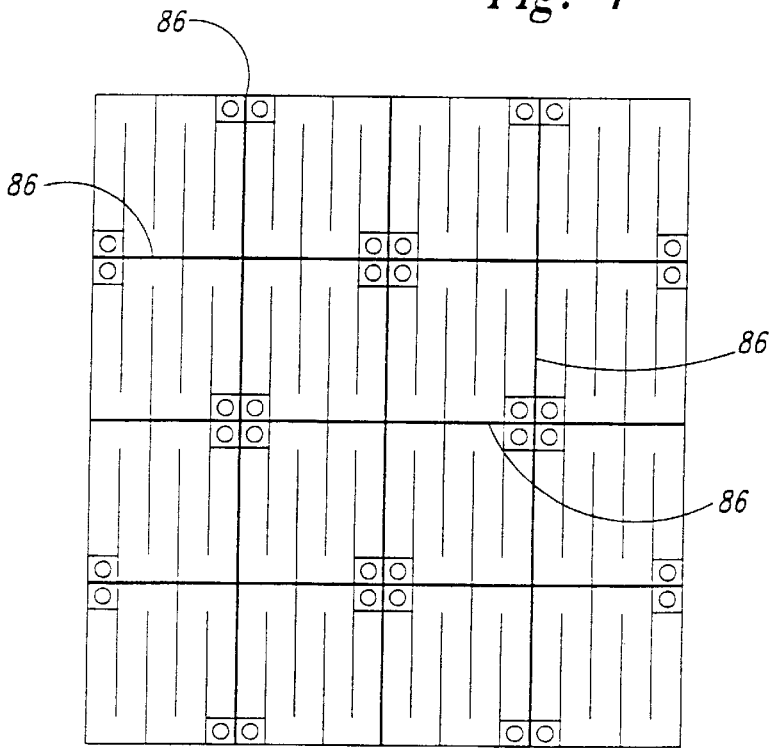
FIG. 13 is a top plan view of a four-by-four array of lamps each having five channel sections.

Because the electrode structure as described above enable the lamp 40 to emit light from substantially the entire area of the lamp 40, several lamps may be tiled in a two-dimensional array to form a single planar light source emitting light substantially uniformly throughout the array (FIG. 13). To further minimize nonuniformity due to discontinuities at the interfaces 86 between adjacent lamps, the sideward edges 88 (best seen in FIGS. 2 and 10) of the cover 50 are polished to a smooth, transparent finish so that any light exiting sidewardly from a lamp cover is transmitted to an adjacent lamp cover, helping to spread light among the lamps. Alternatively, the edges 88 of the lamps may be beveled, as shown in FIGS. 8 and 9, to reflect light outwardly from the lamp 40 at its perimeter, minimizing dark lines at the juncture between adjacent lamps.

It will be appreciated that various combinations of the elements described in each of the embodiments may be made without departing from the scope of the invention. For example, the dome-like housing structure of FIGS. 10, 11, and 12 may be used in the metal lamp structure of FIGS. 7, 8, and 9 and the dual-cover structure of FIG. 10 may be employed in any of the other embodiments. Also, the reflective layer 47 coating the outside of the lamp body 52 may be used in an embodiment employing a serpentine channel to compensate for nonuniformities caused by the channel walls 54. Various other modifications may be made to the structure of the embodiments described herein without departing from the scope of the invention. Accordingly, the invention is not limited except as by the claims.

I claim:

1. A planar fluorescent lamp, comprising:

first and second electrodes;

a first housing having top and bottom portions to enclose the first electrode and an aperture smaller than the first housing;

a second housing having top and bottom portions to enclose the second electrode and an aperture smaller than the second housing;

a lamp body defining a chamber having a light emissive face and a base portion opposite the emissive face, the lamp body including a plurality of channel walls defining a plurality of channel sections, the base portion including an inner face facing the cover and an outer face opposite the inner face within the chamber, the first and second housings being coupled to the lamp body with the chamber being in fluid communication with the apertures of the first and second housings;

an emissive gas within the chamber;

a fluorescent material within the chamber and coating at least a region of the base portion; and a plurality of electrode terminals each coupled to one of the electrodes and each having a portion external to the respective electrode housing.

2. The lamp of claim 1 wherein each of the first and second housings includes a seal supporting the respective electrode.

3. The lamp of claim 2 further including an ion barrier carried by the seal.

4. The lamp of claim 2 further including a secondary electrode carried by one of the seals.

5. The lamp of claim 1 wherein the first and second housings are spaced apart along a common edge of the base portion.

6. The lamp of claim 1 wherein each of the first and second housings includes a respective tabulation.

7. A planar fluorescent lamp, comprising:

a baseplate;

a second plate defining a lamp cover fixedly positioned with respect to the baseplate;

a first electrode;

a first housing mounted to the baseplate, the first housing having top and bottom portions to enclose the first electrode and an aperture smaller than the first housing; and a tabulation within the first housing.

8. The lamp of claim 7, further comprising a secondary electrode positioned within the first housing and supported by the first housing.

9. The lamp of claim 7 wherein the first housing includes a passageway extending through the first housing, the lamp further including a seal sealing the passageway, the seal carrying the first electrode.

10. The lamp of claim 9 further including an ion barrier carried by the seal.

11. The lamp of claim 7, further comprising a second electrode and a second housing having top and bottom portions to enclose the second electrode and an aperture smaller than the second housing.

12. A planar photoluminescent lamp, comprising:

first and second electrodes;

a first housing having top and bottom portions to enclose the first electrode and an aperture smaller than the first housing;

a second housing having top and bottom portions to enclose the second electrode and an aperture smaller than the second housing;

a lamp body defining a chamber having a light emissive face and a base portion opposite the emissive face, the lamp body including a plurality of channel walls defining a plurality of channel sections, the channel sections being inked to form a channel, the base portion including an inner face facing the cover and an outer face opposite the inner face within the chamber, the first and second housings being coupled to the lamp body with the chamber being in fluid communication with the apertures of the first and second housings;

a photoluminescent material within the chamber and coating at least a region of the base portion;

an emissive gas within the chamber; and a plurality of electrode terminals coupled to each of the electrodes, each of the electrode terminals having a portion external to the respective housing.

13. The lamp of claim 12 wherein the first and second housings are spaced apart along a common edge of the base portion.

14. The lamp of claim 12 wherein each of the first and second housings includes a respective tabulation.

* * * * *